US010143905B2

(12) United States Patent
Strong

(10) Patent No.: US 10,143,905 B2
(45) Date of Patent: Dec. 4, 2018

(54) BASEBALL SWING TRAINER

(71) Applicant: John Strong, West Seneca, NY (US)

(72) Inventor: John Strong, West Seneca, NY (US)

( * ) Notice: Subject to any disclaimer, the term of this patent is extended or adjusted under 35 U.S.C. 154(b) by 0 days.

(21) Appl. No.: 15/594,151

(22) Filed: May 12, 2017

(65) Prior Publication Data

US 2017/0326426 A1 Nov. 16, 2017

Related U.S. Application Data

(60) Provisional application No. 62/335,107, filed on May 12, 2016.

(51) Int. Cl.

| | |
|---|---|
| ***A63B 69/00*** | (2006.01) |
| *A63B 21/04* | (2006.01) |
| *A63B 21/02* | (2006.01) |
| *A63B 69/38* | (2006.01) |
| *A63B 63/00* | (2006.01) |
| *A63B 71/02* | (2006.01) |

(52) U.S. Cl.

CPC ..... *A63B 69/0002* (2013.01); *A63B 21/026* (2013.01); *A63B 21/04* (2013.01); *A63B 63/003* (2013.01); *A63B 69/0057* (2013.01); *A63B 69/0075* (2013.01); *A63B 69/38* (2013.01); *A63B 2069/0008* (2013.01); *A63B 2071/027* (2013.01)

(58) Field of Classification Search

CPC ... A63B 21/04; A63B 21/026; A63B 69/0057; A63B 69/0002; A63B 69/0075; A63B 69/38; A63B 63/003; A63B 2069/0008; A63B 2071/027

USPC ..... 473/453, 422–430, 454, 451, 417, 446; 482/109, 122, 148; 434/247; 273/407

See application file for complete search history.

(56) References Cited

U.S. PATENT DOCUMENTS

| | | | | |
|---|---|---|---|---|
| 3,386,733 | A | 6/1968 | Russo et al. | |
| 3,475,026 | A * | 10/1969 | Cooper | A63B 69/0002 473/426 |
| 3,618,942 | A * | 11/1971 | Bates | A63B 21/04 473/229 |
| 4,451,036 | A | 5/1984 | Sinclair et al. | |
| 6,435,990 | B1 | 8/2002 | Bradley | |
| 6,461,255 | B1 * | 10/2002 | Smith | A63B 69/0002 473/453 |
| 7,300,365 | B2 * | 11/2007 | Taylor | A63B 69/0057 473/422 |

(Continued)

*Primary Examiner* — Mitra Aryanpour
(74) *Attorney, Agent, or Firm* — Global Intellectual Property Agency, LLC; Daniel Boudwin

(57) ABSTRACT

A baseball swing trainer. The baseball swing trainer includes a housing having a base, a rear wall, and a top portion defining an open center area. A plurality of resistance blades extend downward from the top portion such that they are positioned within the open center area. A fastener is disposed on the rear wall for securing the swing trainer to a vertical structure such as a pole or tree. When a user swings a bat through the open center area, the resistance blades resist the motion of the bat. This enables the user to develop the muscles that are activated during the swing, which helps to increase swing speed and strength. A resistance band removably affixed to the vertical structure can be connected to the end of a bat to accelerate the bat through the natural swing plane, which enhances the neurological firing rate related to swing musculature.

5 Claims, 3 Drawing Sheets

(56) References Cited

U.S. PATENT DOCUMENTS

| | | | | |
|---|---|---|---|---|
| 7,819,763 | B2 | 10/2010 | Campbell et al. | |
| 8,113,968 | B2 * | 2/2012 | Fittler | A63B 63/003 473/422 |
| 8,517,865 | B2 * | 8/2013 | Schumann | A63B 69/0002 473/422 |
| 9,327,175 | B2 * | 5/2016 | Pressley | A63B 69/0002 473/453 |
| 2003/0220177 | A1 * | 11/2003 | Orlando | A63B 21/04 482/148 |
| 2006/0089212 | A1 | 4/2006 | Marchel | |
| 2006/0148597 | A1 | 7/2006 | Pope et al. | |
| 2007/0129182 | A1 * | 6/2007 | Taylor | A63B 69/0057 473/422 |
| 2008/0248900 | A1 | 10/2008 | Hernandez | |
| 2011/0212797 | A1 * | 9/2011 | Adkins | A63B 69/0002 473/451 |

* cited by examiner

BASEBALL SWING TRAINER

CROSS REFERENCE TO RELATED APPLICATIONS

This application claims the benefit of U.S. Provisional Application No. 62/335,107 filed on May 12, 2016. The above identified patent application is herein incorporated by reference in its entirety to provide continuity of disclosure.

FIELD OF THE INVENTION

The present invention relates to baseball swing trainers. More specifically, the present invention provides a baseball swing trainer having a plurality of resistance blades for improving the strength and accuracy of a batter's swing.

BACKGROUND OF THE INVENTION

Baseball, like many sports, requires the player to make a specific motion, such as the swing of a bat. In order to optimize their swing, players must practice and repeat the correct motion until it becomes a muscle reflex. One way players train their swing is to practice in a similar environment to the game, such as a batting cage, which involves repetitively hitting a pitched ball. However, without supervision from a coach, a player could commit to an incorrect swing motion. Once it becomes reflexive, it is very difficult for a player to correct the motion of their swing. Additionally, this method of training fails to add resistance. Resistance training is useful to strengthen muscles and can be used to make a player's swing both faster and stronger. Therefore, it is desirable to provide a baseball swing trainer that simultaneously guides the player's swing on the correct swing path and provides resistance for increasing the speed and strength of the player's swing.

Devices have been disclosed in the prior art that relate to baseball swing trainers. These include devices that have been patented and published in patent application publications. These devices, however, have several drawbacks. The prior art baseball swing trainers are large, heavy, and lack portability. Such swing trainers are difficult to set up. Additionally, the prior art swing trainers fail to provide a means for guiding the individual's bat through the optimal swing path.

In light of the devices disclosed in the prior art, it is submitted that the present invention substantially diverges in design elements from the prior art and consequently it is clear that there is a need in the art for an improvement to existing baseball swing trainers. In this regard the present invention substantially fulfills these needs.

SUMMARY OF THE INVENTION

In view of the foregoing disadvantages inherent in the known types of baseball swing trainers now present in the prior art, the present invention provides a baseball swing trainer wherein the same can be utilized for providing convenience for the user when training to improve the speed, strength, and accuracy of their baseball swing. The baseball swing trainer includes a rear wall, a base disposed on a lower end of the rear wall extending perpendicularly therefrom, and a top portion disposed on an upper end of the rear wall extending perpendicularly therefrom in the same direction as the base. The base, the rear wall, and the top portion define an open center area. A plurality of resistance blades are disposed on a lower side of a free end of the top member, wherein the resistance blades are positioned within the open center area toward a front end thereof. A fastener is disposed on the rear wall for mounting the baseball swing trainer to a vertical structure such as a post, pole, or tree. A resistance band having a first end and a free end may connected to the vertical structure at the first end and to a user's bat at the free end. The bat can then be swung in open air to enhance swing acceleration.

One object of the present invention is to provide a baseball swing trainer having none of the disadvantages of prior art swing trainers.

Another object of the present invention is to provide a baseball swing trainer that is lightweight, portable, and can be mounted to any vertical structure.

A further object of the present invention is to provide a baseball swing trainer having resistance blades that can be added or removed to the device to increase or decrease resistance when a player trains their swing.

Other objects, features, and advantages of the present invention will become apparent from the following detailed description taken in conjunction the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
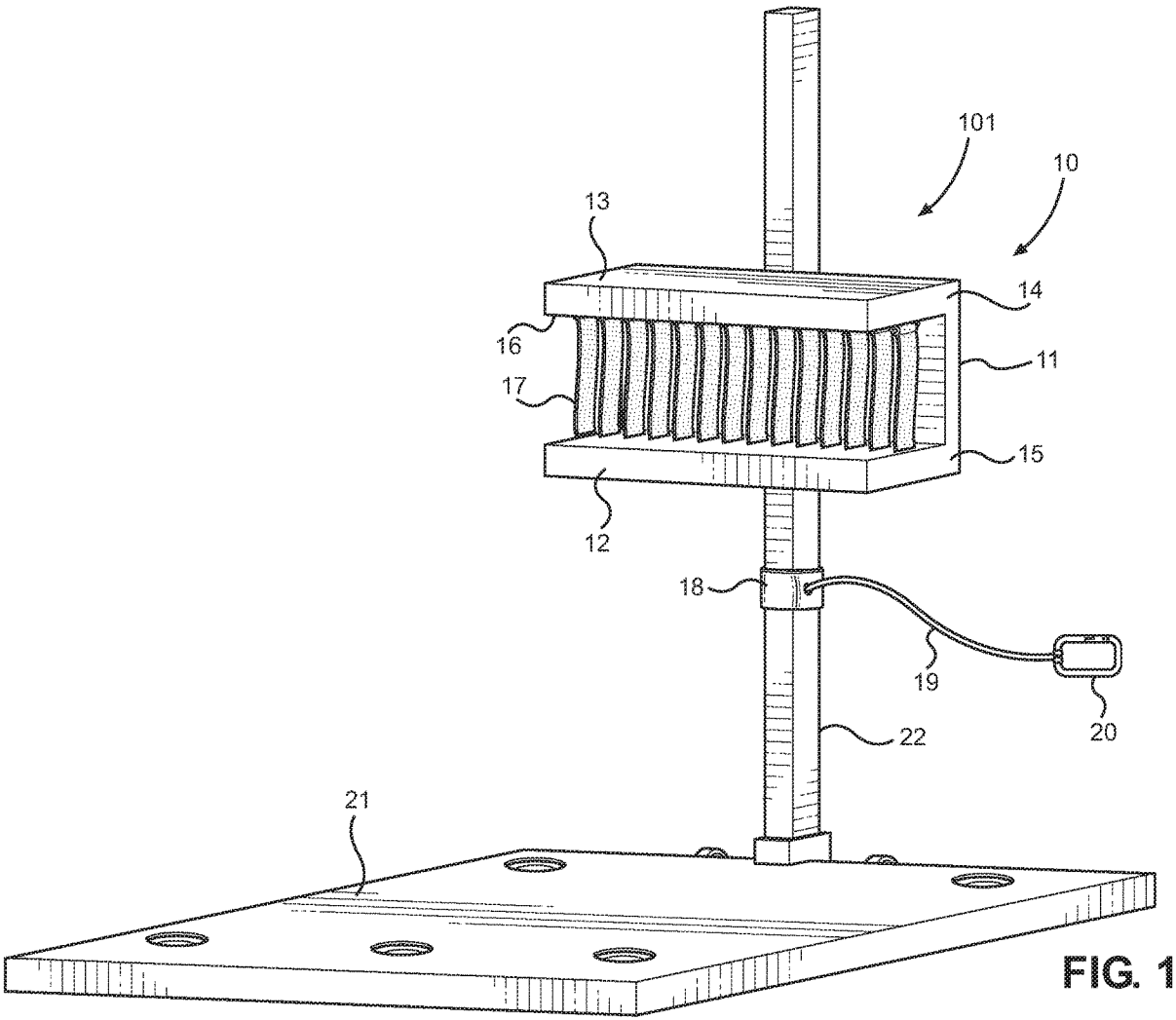
FIG. 1 shows a front perspective view of the baseball swing trainer.

Reference is made herein to the attached drawings. Like reference numerals are used throughout the drawings to depict like or similar elements of the baseball swing trainer. For the purposes of presenting a brief and clear description of the present invention, the preferred embodiment will be discussed as used for training to improve the speed, strength, and accuracy of a baseball swing. The figures are intended for representative purposes only and should not be considered to be limiting in any respect.

Referring now to FIG. 1, there is shown a front perspective view of the baseball swing trainer. The baseball swing trainer 10 comprises a rear wall 11, a base 12 disposed on a lower end 15 of the rear wall, and a top portion 13 disposed on an upper end 14 of the rear wall 11. The top portion 13, rear wall 11, and base 12 define a housing 101. The top portion 14 and base 15 extend perpendicularly from the rear wall 11 in the same direction as one another, forming an open center area therebetween. In the shown embodiment, the top portion 13, rear wall 11, and base 12 are planar members. However, no claim is made to the structure of the housing 101, as the top portion 13, rear wall 11, and base 12 may be formed from any number of support bars and may have open spaces thereon.

In the illustrated embodiment, the swing trainer 10 further comprises a ground supporting base 21 having a vertical support 22 extending perpendicularly therefrom. The housing 101 is secured at any position along the vertical support 22, so that the housing 101 can be adjusted to accommodate players of different heights. In alternate embodiments, housing 101 can be secured to any suitably durable vertical structure such as a post or a pole.

A plurality of resistance blades 17 are disposed in a vertical orientation within the open center area of the housing. In the shown embodiment, the plurality of resistance blades 17 extend downward from a lower side 16 of the top wall 13. The free end of the resistance blades 17 is suspended above the base 12 such that a space exists therebetween. The resistance blades 17 are resilient and flexible, and provide resistance when an individual swings a bat through the open center area, allowing users to develop the muscles that are activated during the swing motion. In the illustrated embodiment, the resistance blades 17 are positioned toward a front portion of the open center area, the front portion being defined as the end opposing the rear wall. The resistance blades are composed of rubber or a similarly resilient material.

A resistance band 19 is further provided with the swing trainer 10. In the illustrated embodiment, the resistance band 19 is secured to a vertical support 22 via a fastener 18. In alternate embodiments, the fastener 18 can secure the resistance band to the housing 101. The resistance band 19 further includes a connector 20 on a free end thereof. The connector 20 is configured to secure the resistance band 19 to a baseball bat. The resistance band 19 is elastic and provides additional resistance which adds velocity to the batter's swing, further improving the firing rate of the player's swing muscles.

Figure 2:
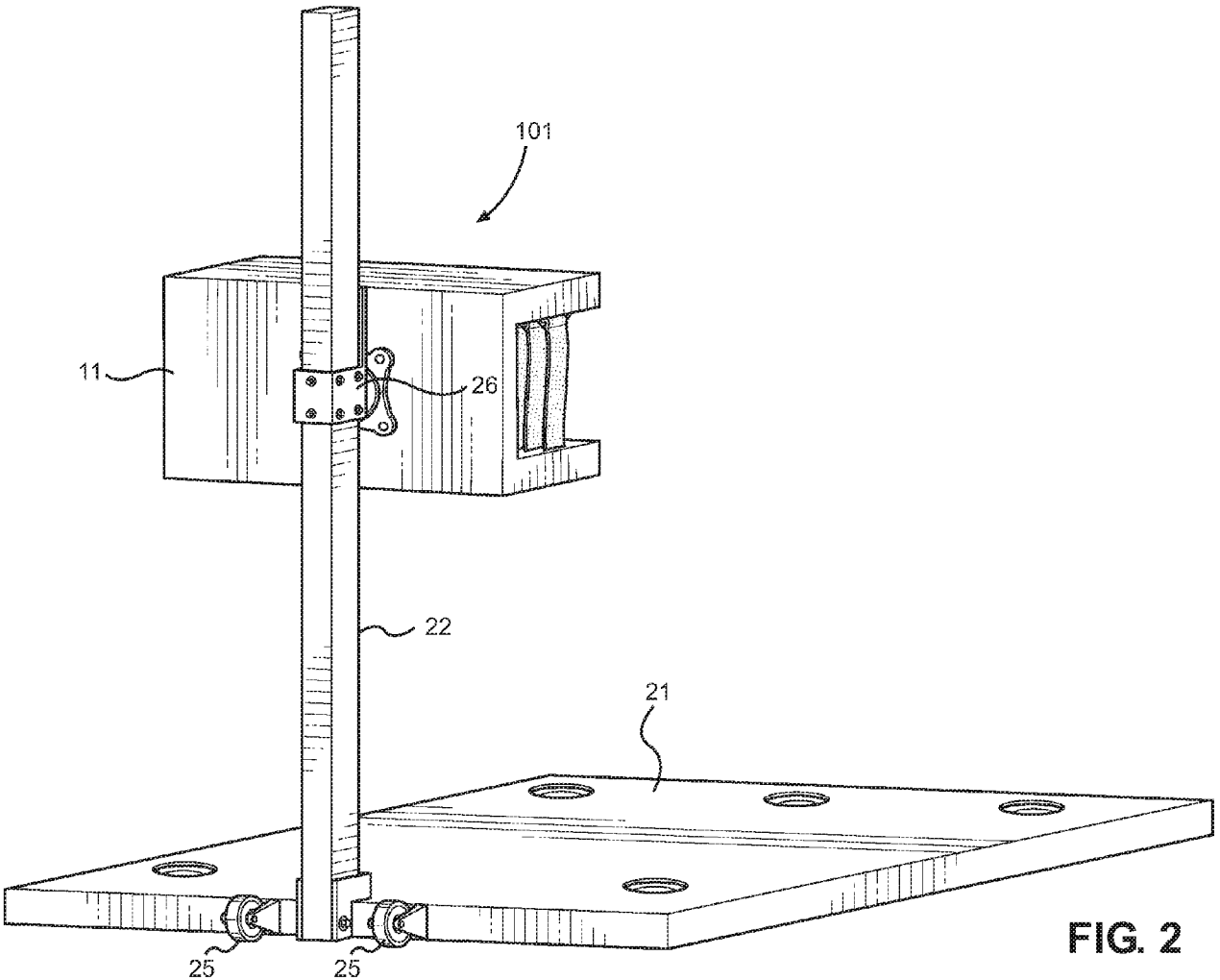
FIG. 2 shows a rear perspective view of the baseball swing trainer.

Referring now to FIG. 2, there is shown a rear perspective view of the baseball swing trainer. In the shown embodiment, the ground supporting base 21 includes a pair of wheels 25. The pair of wheels 25 may be disposed on opposing sides of the vertical support 22. The pair of wheels 25 allow the ground supporting base 21 to be easily supported along with the housing 101 secured thereto. A bracket 26 is disposed on the rear wall 11 of the housing 101. The bracket 26 is configured to removably secure the housing 101 to the vertical support 22 and can be secured anywhere therealong. In the illustrated embodiment, the bracket 26 comprises a sleeve having a plurality of set screws that engage the vertical support 22. In an alternate embodiment, the bracket 26 can comprise ratchet straps or any other suitable fastener for securing the housing 101 to a vertical support 22.

Figure 3:
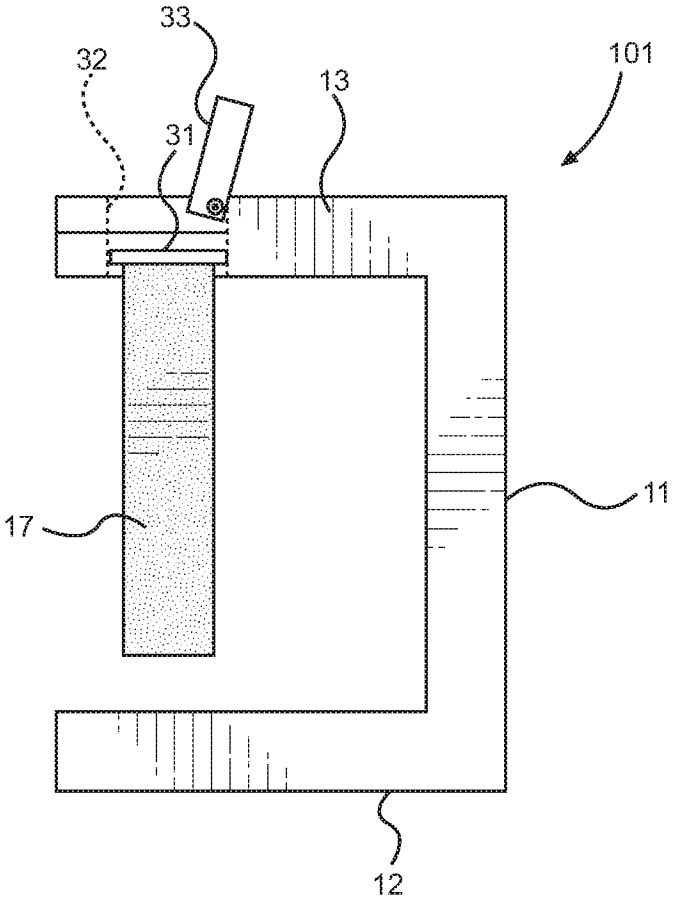
FIG. 3 shows a side view of the baseball swing trainer.

Referring now to FIG. 3, there is shown a side view of the baseball swing trainer. In the shown embodiment, the upper end 31 of the resistance blade 17 is slidably inserted into a slot 32 disposed within the top wall 13. The resistance blade 17 can be removed from the slot 32. A slot cover 33 is hingedly secured to the top wall 13. The slot cover 33 is configured to rotate downward and cover the slot 32, which effectively locks the resistance blade 17 within the slot 32. In order to remove a resistance blade 17, the user can rotate the slot cover 33 to an open position, and then lift the resistance blade 17 out of the slot 32.

Since the resistance blades 17 are removable from the top wall 13, the user can customize the number of resistance blades 17, which changes the overall resistance when a user swings a bat through the resistance blades 17. Similarly, the height of the housing 101 can be adjusted along a vertical support in order to position the resistance blades 17 in the path of the user's optimal swing motion. The resistance blades 17 can vary in thickness, or may all be of uniform thickness. If the user wishes to have less resistance, the user simply removes some of the resistance blades 17, which makes it easier for the bat to swing therethrough. Alternatively, the user can add resistance blades 17 to increase the resistance on the bat. In this way, the resistance can be customized to suit an individual player's skill level, strength, or other preference.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A baseball swing trainer, comprising:

a support structure;

a rear portion;

a bottom portion disposed on a lower end of the rear portion extending perpendicularly therefrom;

a top portion disposed on an upper end of the rear portion extending perpendicularly therefrom in the same direction as the bottom portion;

the bottom portion, the rear portion, and the top portion defining a housing having open center area, wherein the housing is slidably supported on the support structure;

a plurality of resistance blades disposed within the open center area along an interior side of the housing, wherein each of the plurality of resistance blades removably engages a single slot of a plurality of slots disposed on the top portion;

hingedly secured to the top portion, wherein slot cover is configured to rotate between a closed position so as to lock the plurality of resistance blades within an individual slot of the plurality of slots, and an open position such that each resistance blade of the plurality of resistance blades can be either inserted in or removed from an individual slot of the plurality of slots in order to achieve a desired resistance;

a slot cover hingedly secured to the top portion for providing a cover for the plurality of slots, wherein the slot cover is configured to pivot between a closed position and an open position such that each resistance blade of the plurality of resistance blades can be either inserted in or removed from an individual slot of the plurality of slots in order to change the overall resistance when a user swings a bath through the plurality of resistance blades;

wherein the plurality of resistance blades extend downward such that a free end of each of the plurality of resistance blade occupies the open center area toward a front end thereof;

wherein removal of one of the plurality of resistance blades is configured to decrease the overall resistance when a user swings a bat through the open center area and contacts the plurality of resistance blades, and wherein addition of one resistance blade of the plurality of resistance blades is configured to increase the overall resistance when a user swings a bat through the open center area and contacts the resistance blades.

2. The baseball swing trainer of claim 1, further comprising a resistance band having a first end and a free end, the first end being connected to the baseball swing trainer, and a fastener disposed on the free end, the fastener configured to secure the resistance band to a baseball bat.

3. The baseball swing trainer of claim 1 further comprising a bracket disposed on the rear portion, and wherein the support structure comprises a vertical support and the bracket is configured to secure the housing to the vertical support.

4. The baseball swing trainer of claim 1, wherein the plurality of resistance blades are removably secured to a lower side of the free end of the top portion.

5. The baseball swing trainer of claim 1, wherein the support structure comprises a platform a platform supported on the ground and a vertical support extending upwardly therefrom, wherein a fastener of the rear portion is secured at a position along the vertical support.

* * * * *